United States Patent [19]

DeLaMater

[11] 4,058,372

[45] Nov. 15, 1977

[54] FLUE GAS CONDITIONING WITH SPIKING GAS CONTAINING SULFUR TRIOXIDE

[75] Inventor: George B. DeLaMater, Media, Pa.

[73] Assignee: Air Products and Chemicals, Inc., Allentown, Pa.

[21] Appl. No.: 698,690

[22] Filed: June 22, 1976

[51] Int. Cl.[2] ..... B03C 1/00

[52] U.S. Cl. ..... 55/5; 423/242

[58] Field of Search ..... 55/4, 5, 73, 11, 106, 55/107; 423/242, 215.5, 522

[56] References Cited

U.S. PATENT DOCUMENTS

| | | | |
|---|---|---|---|
| 3,581,463 | 6/1971 | Roberts | 55/4 |
| 3,686,825 | 8/1972 | Busby | 55/5 |
| 3,689,213 | 9/1972 | Guerrieri | 55/4 |
| 3,704,569 | 12/1972 | Hardison et al. | 55/4 |
| 3,722,178 | 3/1973 | Aaland et al. | 55/4 |

FOREIGN PATENT DOCUMENTS

| | | | |
|---|---|---|---|
| 703,993 | 2/1954 | United Kingdom | 55/5 |

*Primary Examiner*—Bernard Nozick

*Attorney, Agent, or Firm*—Russell L. Brewer; E. Eugene Innis; H. Barry Moyerman

[57] ABSTRACT

This invention relates to an improvement in a process for treating a flue gas with a spiking gas containing sulfur trioxide. In this process, the concentration of sulfur trioxide in the spiking gas is maintained in a proportion of from about 0.15 to 1.2 mol percent, and the temperature of the spiking gas is maintained such that during any stage of mixing of the spiking gas with the flue gas, the resulting temperature of the mixture is not more than 10° C below the dew point, the dew point being determined by equation.

5 Claims, 6 Drawing Figures

FLUE GAS CONDITIONING WITH SPIKING GAS CONTAINING SULFUR TRIOXIDE

BACKGROUND OF THE INVENTION

1. Field

The removal of particulates from flue gases, particularly gases generated by the electrical power industry, has achieved considerable attention in recent years. One of the reasons for this attention is due primarily to the fact that government regulations prohibit substantial emission of particulates to the atmosphere.

Large particles are easily removed from the flue gas by mechanical devices; however, finer particles, e.g. fly ash, smaller than a few microns in size must be removed by other means. Electrostatic precipitators have been used to remove fly ash particulates but low sulfur fossil fuels do not respond well to fly ash removal by this method. To enhance efficiency of removal of fly ash from flue gas obtained from low sulfur coal, it has been customary to add sulfur trioxide in a proportion of from about 5–50 ppm, preferably 15–25 ppm, to the gas in order to enhance conductivity of the ash.

2. Description of the Prior Art

U.S. Pat. No. 2,602,734 discloses a method for recovering suspended material in gases from the flash roasting of sulfide ores such as zinc blende. The improved method comprises introducing sulfuric acid as a conditioning agent in a proportion of about 1.45 to about 2.9 grains (calculated as $H_2SO_4$) per cubic foot of gas, directly into the roasting or flue gas and then precipitating the particulates by passing the gas through an electrostatic precipitator.

U.S. Pat. No. 2,746,563 discloses a method for treating flue gases by catalyzing the conversion of sulfur dioxide formed on burning of coal to sulfur trioxide and then precipitating the fly ash from the flue gas. Of course in this method the proportion of sulfur dioxide varies with the concentration of sulfur in the coal.

U.S. Pat. No. 3,689,213 discloses a method for treating flue gases by generating sulfur dioxide in the immediate vicinity of the point of use, burning the sulfur dioxide in excess air and forming a spiking gas, introducing the spiking gas into the flue gas, and then precipitating the particulates by electrostatic means. The example shows introducing a spiking gas having a sulfur trioxide concentration of about 5 per cent and a temperature of 520° F into the flue gas.

U.S. Pat. No. 3,704,569 discloses a method for conditioning flue gas with sulfuric acid by forming a spiking gas having a temperature of about 435° F and sulfuric acid concentration of about 2.8 percent, introducing the spiking gas containing vaporized sulfuric acid into the flue gas and precipitating the particulates by electrostatic means.

U.S. Pat. No. 3,581,463 discloses a process for removing particulates from a flue gas by diverting a small sidestream of flue gas, precipitating the particulates therein to prevent catalyst fouling, oxidizing the sulfur dioxide present in the sidestream in a catalytic converter to sulfur trioxide, and then reintroducing and mixing the sidestream containing sulfur trioxide with the flue gas prior to precipitation. The patentee reports that the sidestream coming from the boiler is about 800° F and contains about 0.1 percent by volume sulfur dioxide. After conversion the sidestream containing sulfur trioxide is mixed with 300° F flue gas.

SUMMARY OF THE INVENTION

This invention relates to an improvement in a basic process for treating or conditioning flue gas to aid in the removal of particulates, generally fly ash. Broadly, the basic process comprises removing fly ash from a flue gas by treating the flue gas in a mixing zone with sufficient spiking gas containing sulfur trioxide to provide an effective proportion of sulfur trioxide for conditioning the flue gas, and then precipitating the fly ash from the flue gas by electostatic means. The improvement for conserving energy and avoiding substantial condensation of sulfuric acid formed by the in situ combination of sulfur trioxide and water in the mixing zone comprises:

forming a spiking gas containing from about 0.15 to 1.2 mol percent sulfur trioxide;

maintaining the spiking gas at a temperature sufficiently high such that on mixing the spiking gas with the flue gas, the temperature of any mixture of spiking gas and flue gas as determined by equation I below $$T = \frac{NT^sC_p^s + T^fC_p^f}{NC_p^s + C_p^f} \qquad \text{Equation I}$$

wherein: $T$ = Temperature of the mixture of spiking gas and flue gas in degrees centigrade $N$ = Mols of spiking gas employed per mol of flue gas $T^s$ = Temperature in degrees centigrade of the spiking gas $T^f$ = Temperature of the flue gas in degrees centigrade $C_p^s$ = Heat capacity of the spiking gas in Cal/mol/° C $C_p^f$ = Heat capacity of the flue gas in Cal/mol/° C is not more than 10° C below the dew point temperature of that gas mixture as determined by the equation II below:

$$1/T_{DP} = 0.002276 - 0.00002943 \ln p_{H_2O} - 0.0000858 \ln p_{H_2SO_4} + 0.00000620(\ln p_{H_2SO_4})(\ln p_{H_2O}) \qquad \text{Equation II}$$

wherein: $T_{DP}$ = Dew Point ° K and, $p_{H_2O}$ and $p_{H_2SO_4}$ are partial pressures of water and sulfuric acid in mm Hg.

Advantages of this invention include:

the ability to avoid condensation of sulfuric acid forced by the in situ combination of sulfur trioxide and water in the mixing zone and to avoid the corrosion problems, normally encountered in previous prior art processes;

the ability to prevent the formation of a visible and toxic plume of sulfuric acid fog, and concomitant unnecessary wastage of conditioning agent, the ability to determine accurately optimum concentrations and temperatures which permit closer process control thereby conserving valuable energy; and the ability to select sulfur trioxide concentrations and spiking gas temperatures which avoid substantial dissociation of sulfur trioxide.

THE DRAWINGS

DESCRIPTION OF THE PREFERRED EMBODIMENT

Figure 1:
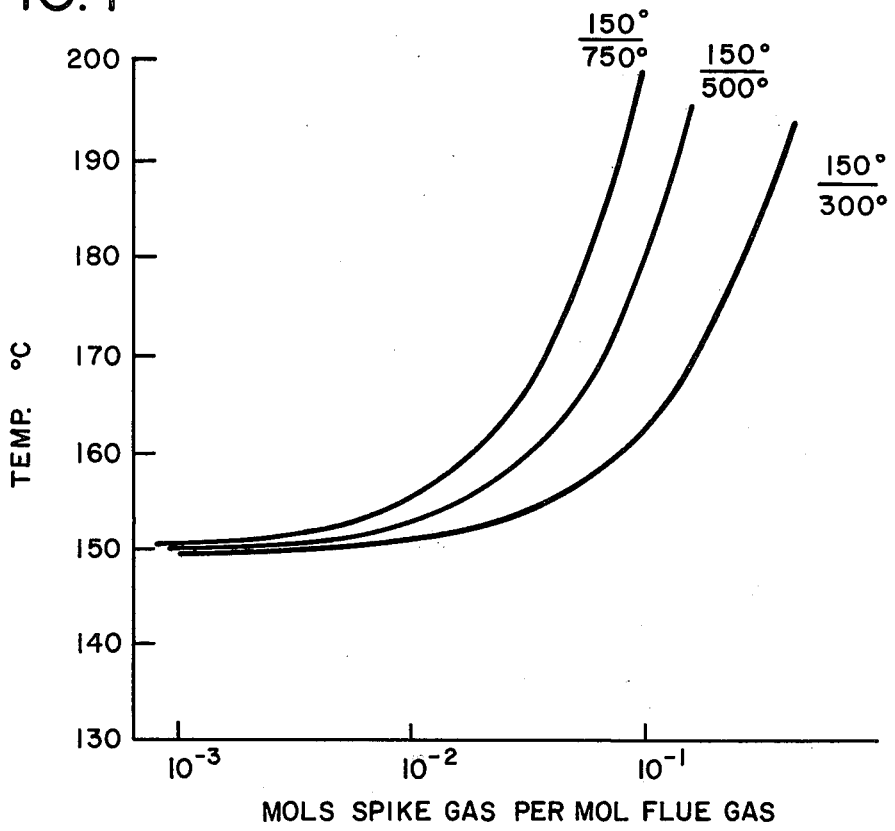
FIG. 1 is a plot of the temperature of homogeneous mixtures of varying proportions of 150° C flue gas and 300° C, 500° C and 750° C spiking gas vs. mols of spiking gas per mol of flue gas as determined by equation I.

Even though it is apparent in the prior art processes that recognition has been given to sulfur trioxide condensation in the treatment of flue gases, it is clear that the investigators have not recognized what I believe to be the key area which is the source of most problems in flue gas conditioning. Basically, in the prior art (examples), investigators have looked at the dew point temperature of the spike gas at the point of introduction and/or the flue gas at the point of exhaust from the system, and concluded that in their processes the temperatures and sulfur trioxide concentrations so determined were sufficient avoid condensation. Blame for the problems in plant operations was charged to other factors. I have found that the failure of the prior art was in not avoiding sulfuric acid fogging which resulted from nonrecognition of the fact that substantial condensation of sulfuric acid can and does occur in the dilution stage or mixing zone where the spiking gas is introduced, mixed and diluted. My process recognizes this fact and takes the necessary steps to avoid condensation. My process also takes added steps to save energy in the treatment steps.

Essential to the operation of this invention is the formation of a spiking gas having a temperature and concentration of sulfur trioxide such that when the spiking gas is mixed with a flue gas in a proportion sufficient for conditioning the flue gas, e.g. to provide from 5–50 ppm and preferably 15–25 ppm sulfur trioxide, there is no opportunity for substantial condensation of sulfuric acid formed by the in situ combination of water and sulfur trioxide at any stage in the mixing zone. In practicing this invention one selects a temperature and concentration of sulfur trioxide between about 0.15 to about 1.2 mol percent, calculates the temperatures of several mixtures of spiking gas and flue gas, and then compares these with the calculated dew point temperatures of the mixtures. If the temperature of any mixture is not more than 10° C below the dew point temperature as will be explained in the passage to follow, the spiking gas is suited for flue gas treatment.

The temperature of any mixture of spiking gas and flue gas is calculated by the following equation:

$$T = \frac{NT^sC_p^s + T^fC_p^f}{NC_p^s + C_p^f}$$

wherein: $T$ = Temperature of the mixture of spiking gas and flue gas in degrees centigrade $N$ = Mols of spiking gas per mol of flue gas $T^s$ = Temperature of the spiking gas in degrees centigrade $T^f$ = Temperature of the flue gas in degrees centigrade $C_p^s$ = Heat capacity of the spiking gas in Cal/mol/° C.

$C_p^f$ = Heat capacity of the flue gas in Cal/mol/° C

The dew point temperature of the mixtures of the spiking gas and flue gas are calculated in order to define the operably parameters of the process. It has been my experience that the dew point equation of Verhoff and Banchero as reported in Chemical Engineering Progress, Volume 70, No. 8, August, 1974 is sufficiently accurate for this determination. That equation is as follows:

$$1\ T/_{DP} = 0.002276 - 0.00002943 \ln p_{H_2O} - 0.0000858 \ln p_{H_2SO_4} + 0.00000620(\ln p_{H_2SO_4})(\ln p_{H_2O})$$

wherein: $T_{DP}$ = Dew Point ° K and, $P_{H_2SO_4}$ and $p_{H_2O}$ are partial pressures of sulfuric acid and water in mm Hg.

To facilitate the solution of the Verhoff and Banchero equation, which utilizes the partial pressure of water and sulfuric acid, in the determination of dew point temperature, it is convenient to solve for the mol fraction of the water and sulfuric acid components in the mixing zone and then convert the mol fractions to partial pressures in mm Hg. The mol fractions of water and sulfuric acid can be determined from the equation $$X_a = \frac{NX_a^s + X_a^f}{1 + N}\ ;\ P_a = 760\ X_a$$

wherein: $X_a$ = Mol fraction of component ($a$) in the mixture $X_a^s$ = Mol fraction of component ($a$) in the spiking gas $X_a^f$ = Mol fraction of component ($a$) in the flue gas $N$ = Mols of spiking gas employed per mol of flue gas $P_a$ = partial pressure in mm Hg of component ($a$) in the mixture Although the Verhoff and Banchero equation considers the mol fraction of water in determining dew point, and the dew point temperature may shift upwardly or downwardly depending on the concentration of water, the water content in typical power plant flue gases generally does not deviate sufficiently to cause a substantial upward or downward movement of the dew point temperature. As a result, the average moisture content in the flue gas for the particular plant is used in the calculation.

Figure 2:
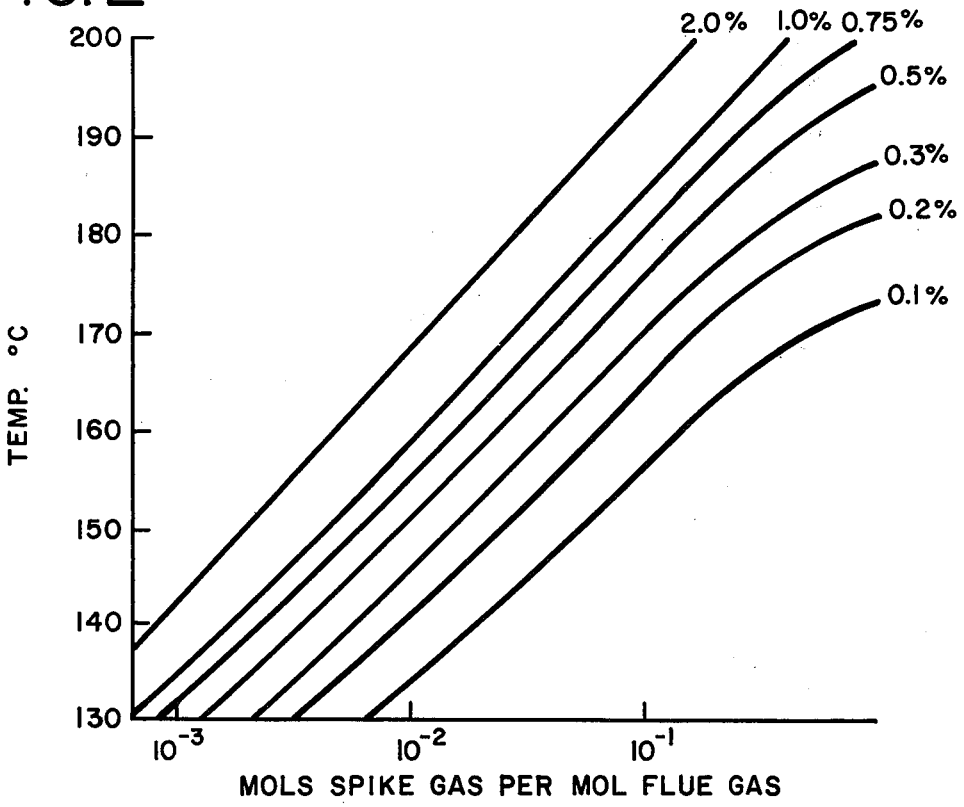
FIG. 2 is a plot of dew point temperature as determined by equation II vs. mols spiking gas per mol of flue gas for different concentrations of sulfur trioxide in the spiking gas.
Figure 3:
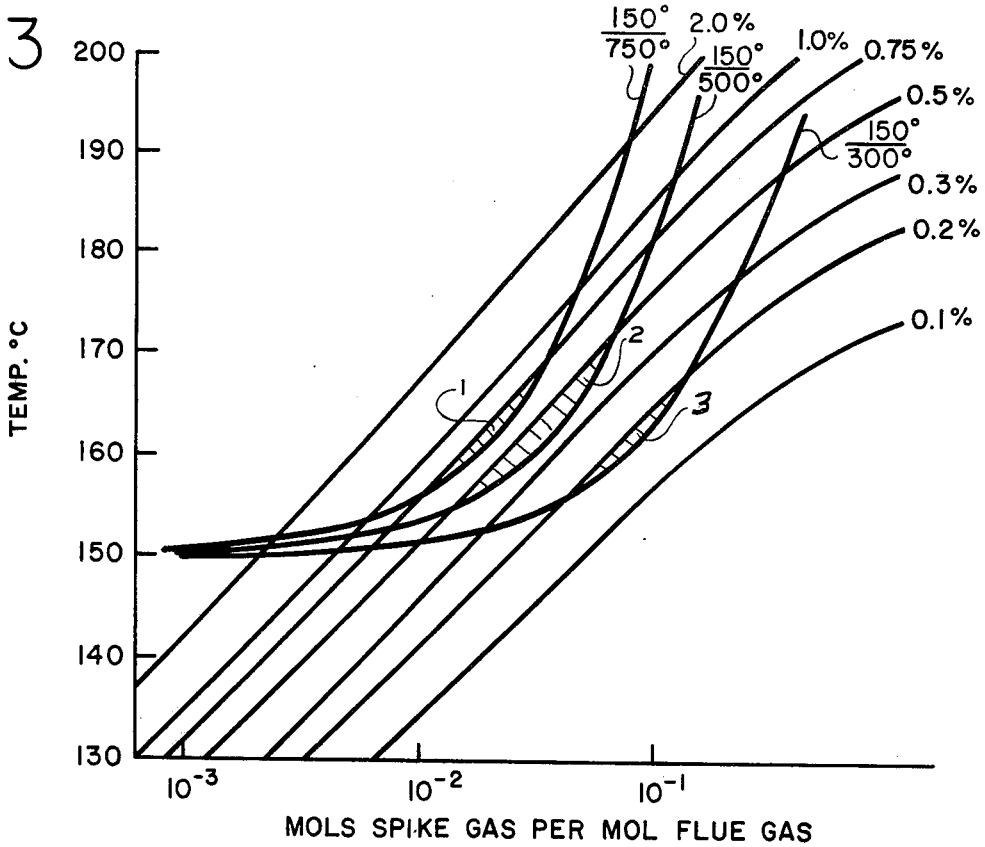
FIG. 3 is a plot of FIG. 2 superimposed over FIG. 1 and provides a comparison between the temperature of the flue gas-spiking gas mixture vs. the dew point temperature of the mixture using various spiking gas concentrations.
Figure 4:
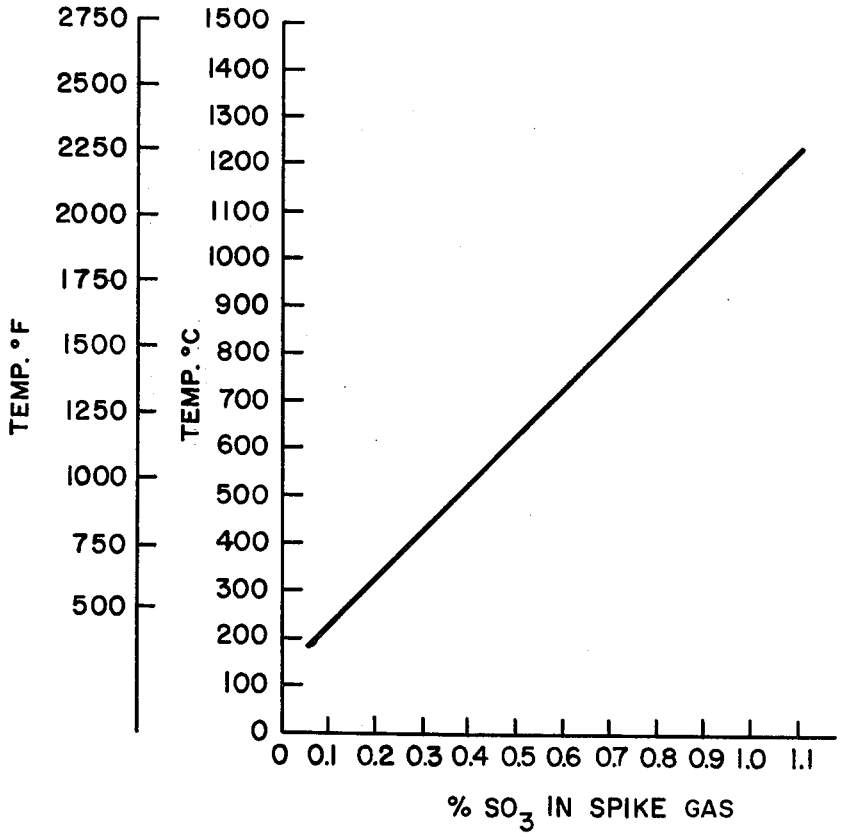
FIG. 4 is a plot of the temperature of spiking gas required to avoid condensation, in 150° C flue gas, as a function of the sulfur trioxide content in the spiking gas.
Figure 5:
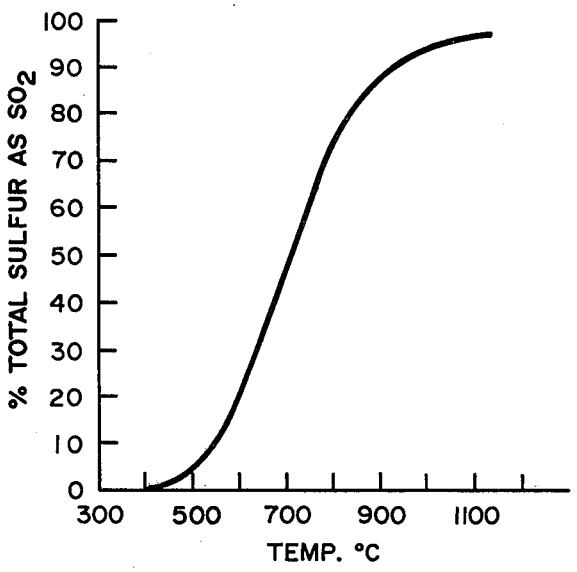
FIG. 5 is a plot of the percentage of dissociation into sulfur dioxide and oxygen as a function of temperature of a mixture containing initially one percent sulfur trioxide and 99 percent air.

Once the dew point temperatures of the respective spiking gas-flue gas mixtures are calculated they should be plotted for several different sulfur trioxide concentrations in the spiking gas as noted in FIG. 2. This plot aids in the selection of a spiking gas temperature, as well as a desirable concentration within the 0.15–1.2 mol percent range of sulfur trioxide such that it will avoid substantial condensation of sulfur trioxide as sulfuric acid. This is done by simply superimposing FIG. 2 over FIG. 1 as shown in FIG. 3. With FIG. 3, it is now possible to determine which spiking gases will result in sulfuric acid condensation and which will avoid sulfuric acid condensation. If the resulting temperature profile of the gas mixture is at or above the dewpoint temperature for the particular spiking gas employed, one is assured that there will be no condensation of sulfuric acid in the mixing zone. On the other hand, if the temperature profile falls below the dewpoint profile the possibility of sulfuric acid condensation exists. Generally, one can tolerate a spiking gas-flue gas temperature somewhat below the dewpoint temperature profile without incurring adverse effects, and indeed a small excursion into the regime where sulfuric acid condensation is possible may be advantageous since it can accelerate condensation of sulfuric acid on the suspended fly ash particles; the process by which the conductivity of the ash is increased to an acceptable value. The excursion into the danger zone, i.e. the zone of supersaturation however, must be carefully controlled. The amount of condensation which can occur depends both upon the driving force, (i.e. the degree of supersaturation) and the amount of time which the gas is in the supersaturated state. Attempts are made in present flue gas conditioning systems to minimize the time during which fogging can occur by providing a large number of separate injection points and a high degree of turbulence in the mixing zone. However, these efforts are not completely successful as evidenced by the fact that fogging and loss of sulfuric acid is common in installations where a substantial level, e.g. 5 per cent of sulfur trioxide is being introduced.

In my system adverse effects are controlled by not permitting the temperature of the spiking gas-flue gas mixture to fall more than about 10° C below the dewpoint temperature profile. When the temperature of the gas mixture falls more than 10° C below the dewpoint temperature, the degree of fogging is too much and the time frame in which the sulfuric acid remains in the fogging region is too great thus causing adverse results. In a preferred embodiment the temperature profile for the spiking gasflue gas mixture should be not more than 5° C below the dew point profile and in a most preferred embodiment, the spiking gas-flue gas temperature should be from −3° to +5° C of the dew point temperature profile. Higher temperatures, e.g. greater than 5° C, require an unnecessarily large and wasteful expenditure of energy in forming the spiking gas.

Figure 6:
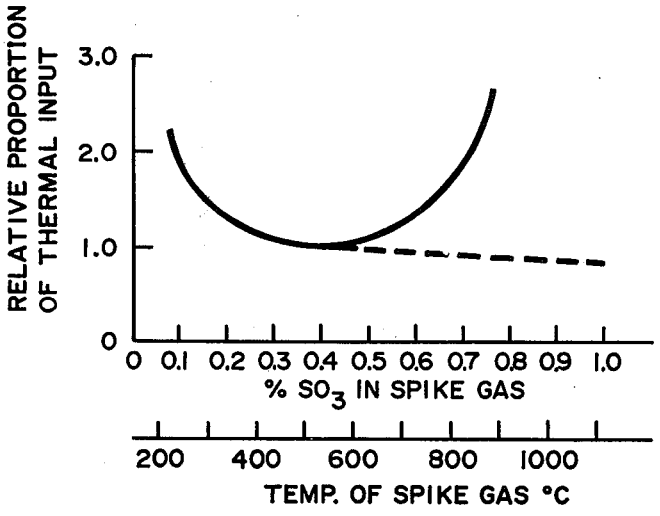
FIG. 6 is a plot of the relative proportion of thermal input of a power plant required to heat the spike gas as a function of mol percent sulfur trioxide in the spiking gas and as a function of the temperature.

The concentration of sulfur trioxide in the spiking gas is confined to a relatively narrow range, e.g. from about 0.15 to 1.2 mol percent. A selection of this concentration range becomes apparent when viewing FIG. 6. FIG. 6 shows the energy required (expressed as a proportion of the total thermal input of the power plant) to raise the spiking gas to the desired temperature. At low sulfur trioxide contents, e.g. below 0.15%, the energy requirement is high because of the large volume of gas which must be heated. So long as inexpensive heat from relatively low temperature sources is available, the energy requirement continues to decline, as shown by the dotted extension of the line. However, temperatures above about 500° C cannot be readily attained by heat exchange, but require use of electric power from the plant. Since the efficiency of even the most modern plants is only about 40%, an increasing proportion of the thermal input of the plant must be diverted to the spiking gas to achieve temperatures above about 500° C, corresponding to sulfur trioxide concentrations of about 0.35% or greater. The actual thermal energy required is shown by the rapidly rising solid line.

Another problem associated with high temperature operation is that the sulfur dioxide formed on dissociation of sulfur trioxide must be removed prior to exhaust from the stack to avoid violation of environmental pollution standards. This aspect again shows the problem with the prior art spiking gases in that on the one hand, corrosion exists because of low temperatures, or on the other hand, there is sulfur dioxide pollution because of high temperature.

As FIG. 6 shows, the preferred operating range for avoiding condensation and minimizing power costs is from about 0.25 to 0.55 mol percent and more preferably from 0.25–0.45 mol percent as toward the upper end higher spiking gas temperatures, e.g. from about 600° to 800° C, are required to maintain tthe mixture of spiking gas and flue gas within 10° C of the dew point temperature.

As stated before in practicing the invention, one may, in order to reduce power costs safely, permit a small excursion into the danger zone and this can be done by increasing the concentration of sulfur trioxide in the spiking gas. As a rule (viewing FIG. 3), the concentration generally can be doubled at a preselected operable temperature without forming a spiking gas-flue gas mixture having a temperature outside the 10° C dew point limitation. This means that less gas will have to be heated. However, to avoid condensation and to achieve advantageous economics, as FIG. 6 demonstrates, spiking gas concentrations should be from about 0.25 to about 0.45 mol per cent sulfur trioxide and the temperature should be from about 350° to about 550° C. This range is well within the capability of most generating plants.

The spiking gas can be formed first and then heated, or formed and heated simultaneously, e.g. by injecting sulfur trioxide into the hot carrier gas. The sulfur trioxide can be formed by conventional techniques, e.g. by oxidizing sulfur dioxide to sulfur trioxide, by vaporizing liquid sulfur trioxide, or vaporizing sulfuric acid in hot air, or hot inert carrier gas.

The following example is provided to illustrate a preferred embodiment of the invention and is not intended to restrict the scope thereof. All percentages are percentages by volume.

EXAMPLE I

A typical flue gas from combustion of a low-sulfur coal, having an average temperature of 150° C and a composition as follows:

| | |
|---|---|
| water | 7.32% |
| carbon dioxide | 17.54% |
| nitrogen | 68.82% |
| oxygen | 6.24% |
| sulfur dioxide | 0.08% |

was conditioned as follows:

Before treating, temperature calculations of incremental mixtures of flue gas and spiking gas using spiking gas temperatures of 300°, 500° and 750° C vs. mols spiking gas per mol of 150° C flue gas were made and plotted as shown in FIG. 1. A 150° C flue gas was selected as this is a typical temperature althoguh it may vary from about 140° to about 160° C. Higher temperatures result in reduced power plant efficiency. After FIG. 1 was prepared, a plot (as shown in FIG. 2) of dew point temperature in ° C vs. mols of spiking gas, having concentrations of sulfur trioxide of from 0.1 to 2 mol percent, per mol of stack gas was made, the dew point temperature being calculated by using the Verhoff and Banchero equation.

With these plots it now is possible to select those spiking gases suited for mixing with the flue gas by superimposing FIG. 2 over FIG. 1. On superimposing, as shown in FIG. 3, it is clear that some condensation will occur for any spiking gas employed where the concentration of sulfur trioxide in the 750° C spiking gas is 0.62 mol percent or greater. As is readily observed, there is a small shaded area 1 below the 0.75 mol percent line which represents a condition in which condensation can occur for gas mixtures of about $10^{-1.5}$ to $10^{-2}$ mol spiking gas per mol flue gas. Area 2, below the 0.5 mol percent line, represents a condition where condensation can occur when using a 500° C spiking gas. Area 3 represents a condition below the 0.2 mol percent where condensation can occur using a 300° C spiking gas.

As mentioned before, one can tolerate small deviations below the dew point temperature, e.g. not more than about 10° C, and preferably not more than 5° C because the time frame in which condensation occurs; i.e., in the danger zone is extremely small. Therefore, in viewing FIG. 3, a spiking gas having a temperature of 300° C should not have a concentration greater than about 0.36 mol percent (double 0.18 mol percent), a spiking gas having a temperature of about 500° C should not have a concentration greater than about 0.75 percent and a 750° C spiking gas should not have a concentration greater than about 1.2 percent discounted for $SO_3$ dissociation. In this example, the spiking gas chosen is at a temperature of 430° C and contains about 0.3 mol percent sulfur trioxide.

The importance of the relationship between temperature of the spiking gas and the concentration of sulfur trioxide and spiking gas is greatly enhanced when comparing the conditions as shown in FIG. 3 against conditions that have been used heretofore. More particularly, the examples in U.S. Pat. No. 3,689,213 show the addition of a spiking gas containing 5 percent sulfur trioxide at a temperature of 520° F (271° C) to a flue gas. It is clear that if that spiking gas were introduced into a typical 150° C flue gas as employed here, there would be substantial fogging as the temperature of the mixture at some points is more than 40° C below the dew point temperature. To avoid sulfuric acid fogging with a spiking gas containing 5 mole percent sulfur trioxide and having a temperature of 520° F, the temperature of the flue gas prior to mixing must be at least 402° F or about 205° C, which is unacceptable in that it represents a substantial amount of heat lost through the stack; alternatively a spiking gas containing 5 mol percent of sulfur trioxide must be heated to over 5000° C. As FIG. 3 shows, the maximum concentration of sulfur trioxide for the spiking gas of U.S. Pat. No. 3,689,213 in a 150° C flue gas should be about 0.35 percent or roughly 1/14 of what was actually employed in order to avoid fogging.

What is claimed is:

1. In a process for removing fly ash from flue gas at a temperature of from about 140° C to about 160° C by
   a. treating the flue gas with a spiking gas containing sulfur trioxide in a sufficient amount for conditioning the flue gas in a mixing zone, and then
   b. precipitating the fly ash from the flue gas by electrostatic means, the improvement which comprises:
      1. forming a spiking gas containing from about 0.15 to 1.2 mol percent sulfur trioxide, and
      2. maintaining the spiking gas at a temperature sufficiently high between a temperature of from about 300° to about 750° C such that on treating the flue gas with the spiking gas, the temperature of any mixture of spiking gas and flue gas from the point of introduction to the point of dilution as determined by the equation $$T = \frac{NT^sC_p^s + T^fC_p^f}{NC_p^s + C_p^f}$$

wherein: $T$ = Temperature of mixture of spiking gas and flue gas in degrees centigrade,
$N$ = Mols of spiking gas per mol of flue gas
$T^s$ = Temperature of the spiking gas in degrees Centigrade,
$T^f$ = Temperature of the flue gas in degrees Centigrade,
$C_p^s$ = Heat capacity of the spiking gas in Cal/mol/° C,
$C_p^f$ = Heat capacity of the flue gas in Cal/mol/° C,
is not more than 10° C below the dew point temperature of the gas mixture as determined by the equation $$1\ T_{DP} = 0.002276 - 0.00002943 \ln p_{H_2O} - 0.0000858 \ln p_{H_2SO_4} + 0.00000620(\ln p_{H_2SO_4})(\ln p_{H_2O})$$

wherein: $T_{DP}$ = Dew Point ° K and, $p_{H_2O}$ and $p_{H_2SO_4}$ are partial pressures in mm Hg.

2. The process of claim 1 wherein the temperature of any incremental mixture of spiking gas and flue gas is not more than 3° C below the dew point temperature of the mixture.

3. The process of claim 2 wherein the concentration of sulfur trioxide in the spiking gas is from about 0.25 to 0.55 mol percent.

4. The process of claim 3 wherein the spiking gas is heated to a temperature of from about 350° C to 550° C.

5. The process of claim 4 wherein the temperature of the mixture of the spiking gas and flue gas is at or above the dew point temperature, but not more than 5° C above the dew point temperature.

* * * * *

UNITED STATES PATENT AND TRADEMARK OFFICE

CERTIFICATE OF CORRECTION

PATENT NO. : 4,058,372

DATED : November 15, 1977

INVENTOR(S) : George B. DeLaMater

It is certified that error appears in the above-identified patent and that said Letters Patent are hereby corrected as shown below:

Column 4, Line 20

Delete formula and substitute therefor the following:

$$1/T_{DP} = 0.002276 - 0.00002943 \ln p_{H_2O} - 0.0000858 \ln p_{H_2SO_4} + 0.00000620(\ln p_{H_2SO_4})(\ln p_{H_2O})$$

Column 6, Line 63

Delete "althoguh" and substitute therefor -- although --

Column 8, Line 39 (Claim 1)

Delete formula and substitute therefor the following:

$$1/T_{DP} = 0.002276 - 0.00002943 \ln p_{H_2O} - 0.0000858 \ln p_{H_2SO_4} + 0.00000620(\ln p_{H_2SO_4})(\ln p_{H_2O})$$

Signed and Sealed this

Seventh Day of March 1978

[SEAL]

Attest:

RUTH C. MASON
Attesting Officer

LUTRELLE F. PARKER
Acting Commissioner of Patents and Trademarks